US005328249A

United States Patent [19]

Ball

[11] Patent Number: 5,328,249

[45] Date of Patent: Jul. 12, 1994

[54] SEAT BELT SYSTEM

[75] Inventor: Keith R. Ball, New Baltimore, Mich.

[73] Assignee: TRW Vehicle Safety Systems Inc., Lyndhurst, Ohio

[21] Appl. No.: 963,377

[22] Filed: Oct. 20, 1992

[51] Int. Cl.[5] ..... A44B 19/00

[52] U.S. Cl. ..... 297/483

[58] Field of Search ..... 24/68 SB, 68 R, 171; 297/483, 484

[56] References Cited

U.S. PATENT DOCUMENTS

| | | | |
|---|---|---|---|
| 3,950,826 | 4/1976 | Knoll et al. | 24/171 |
| 4,372,012 | 2/1983 | Föhl | 297/483 X |
| 4,660,889 | 4/1987 | Anthony et al. | 297/467 |
| 4,848,794 | 7/1989 | Mader et al. | 280/801 |
| 4,893,874 | 1/1990 | Childress et al. | 297/483 |
| 5,031,962 | 7/1991 | Lee | 297/484 |
| 5,123,153 | 6/1992 | Krause | 24/171 X |

*Primary Examiner*—Richard E. Moore
*Attorney, Agent, or Firm*—Tarolli, Sundheim & Covell

[57] ABSTRACT

A seat belt restraining apparatus (10) for restraining movement of a child in a child seat (12) includes a shoulder belt webbing (28) extensible across the shoulders of a child to restrain movement of the child in the child seat. An adjust belt (44) connected with the shoulder belt webbing is movable to adjust the shoulder belt webbing. An adjuster (50) associated with the adjust belt has a locked condition blocking movement of the adjust belt and a release condition enabling movement of the adjust belt. The adjuster includes a slide bar (120) around which the adjust belt extends and which is slidable on a base (54) between a clamping position blocking movement of the adjust belt and a release position enabling movement of the adjust belt. A pull tab (160) connected with the slide bar is manually movable to move the slide bar from the clamping position to the release position to enable movement of the adjust belt. A guide roller (80) is rotatably mounted on the base. The adjust belt extends rearward in the adjuster from the slide bar around the guide roller and thence forward to a location at which the adjust belt can be manually gripped to move the adjust belt.

14 Claims, 3 Drawing Sheets

SEAT BELT SYSTEM

FIELD OF THE INVENTION

The present invention relates to a seat belt system which is used to restrain movement of a vehicle occupant. In particular, the present invention relates to a child seat belt system for restraining movement of a child in a child seat.

DESCRIPTION OF THE PRIOR ART

A child seat belt system for use in a vehicle commonly includes a crotch belt to which is attached a buckle. The buckle interconnects the crotch belt, which extends between the legs of the child, and a pair of shoulder belts which extend across the shoulders of the child. At the end of the shoulder belts is a tongue assembly which latches into the buckle to secure the child in the child seat.

It is desirable to be able to adjust the length of the shoulder belts of a child seat belt system to accommodate children of different sizes or children wearing different thicknesses of clothing. The shoulder belts should be easily adjustable by an adult securing the child in the child seat. The shoulder belts should not be capable of being adjusted by a child seated in the child seat.

SUMMARY OF THE INVENTION

The present invention is a seat belt restraining apparatus for restraining movement of a vehicle occupant in a seat. In the preferred embodiment of the invention, the seat belt restraining apparatus is used for restraining movement of a child in a child seat. The apparatus includes shoulder belt webbing extensible across the shoulders of a child seated in the child seat to restrain movement of the child relative to the child seat. An adjust belt is connected with the shoulder belt webbing and is movable to adjust the shoulder belt webbing.

A seat belt webbing adjuster is associated with the adjust belt. The adjuster has a locked condition blocking movement of the adjust belt to block adjustment of the shoulder belt webbing and a release condition enabling movement of the adjust belt to enable adjustment of the shoulder belt webbing. The adjuster includes a base for connection with the child seat, and a slide bar around which the adjust belt extends. The slide bar is slidable on the base between a clamping position blocking movement of the adjust belt and a release position enabling movement of the adjust belt.

The adjuster preferably includes a pull tab connected with the slide bar. The pull tab is manually engageable to move the slide bar from the clamping position to the release position to enable movement of the adjust belt. The pull tab enables easy lengthening of the shoulder belt webbing by an adult upon moving the slide bar to the release position. Upon subsequent release of the pull tab, tension on the shoulder belt webbing automatically moves the slide bar to the clamping position.

The adjuster preferably includes a guide roller for guiding movement of the adjust belt in the adjuster. The guide roller is rotatably connected with the base of the adjuster at a location to the rear of the slide bar. The adjust belt extends rearward in the adjuster from the slide bar around the guide roller and thence forward to a location at which the adjust belt can be manually gripped to move the adjust belt. The guide roller changes the direction of the path of movement of the adjust belt in the adjuster such that the adjust belt extends rearward toward the guide roller and forward from the guide roller.

BRIEF DESCRIPTION OF THE DRAWINGS

The foregoing and other features of the present invention will become apparent to one skilled in the art to which the present invention relates upon consideration of the following description of the invention with reference to the accompanying drawings, wherein.

DESCRIPTION OF A PREFERRED EMBODIMENT OF THE INVENTION

The present invention relates to a seat belt system and particularly to a seat belt system for restraining movement of a child in a child seat in a vehicle. The present invention is applicable to various seat belt system constructions.

Figure 1:
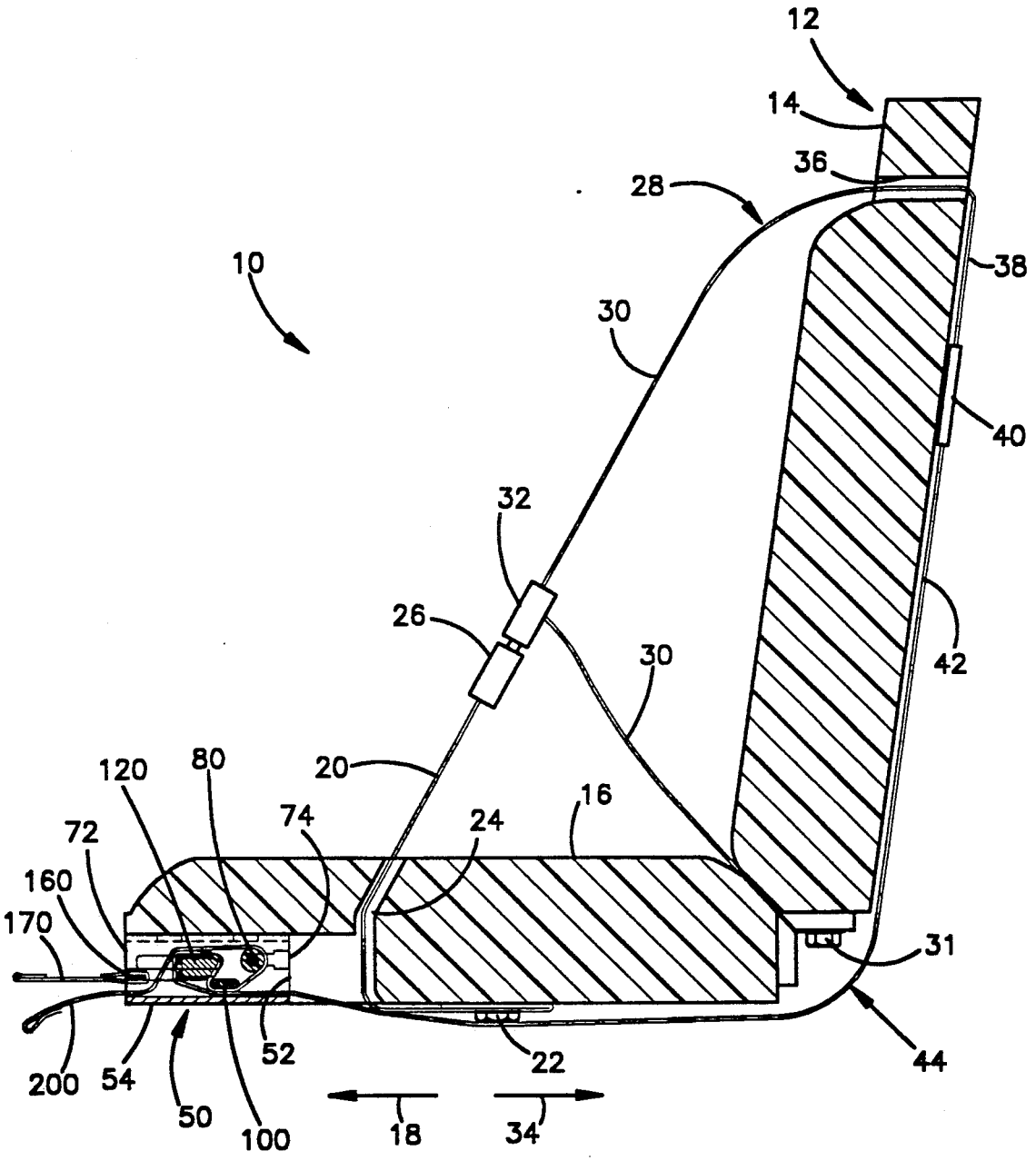
FIG. 1 is a schematic view partly in section of a child seat belt system in accordance with the present invention, including shoulder belt webbing and a belt webbing adjuster for adjusting the shoulder belt webbing.

As representative of the present invention, FIG. 1 illustrates a child seat belt system 10. The system 10 is associated with a child seat 12 which is preferably a fold-down child seat integrated with a vehicle seat (not shown). The child seat 12 includes a seat back 14. The child seat 12 also includes a seat bottom cushion 16 which extends from the seat back 14 in a forward direction as indicated by the arrow 18.

The seat belt system 10 includes a crotch belt 20 which is fixed at one end 22 to the underside of the seat bottom cushion 16. The crotch belt 20 extends through an opening 24 in the seat bottom cushion and terminates in a buckle assembly 26. The seat belt system 10 also includes shoulder belt webbing 28 connectable with the crotch belt 20 to secure a child (not shown) in the seat 12. It should be understood that FIG. 1 illustrates schematically only a single length of shoulder belt webbing 28. An actual seat belt system constructed in accordance with the present invention would also include a second shoulder belt (not shown), as two individual shoulder belts are normally provided to extend across the respective shoulders of a child seated in the child seat 12.

The shoulder belt webbing 28 is preferably one continuous length of belt webbing about one and one-half inches wide. The shoulder belt webbing 28 includes a webbing portion 30 disposed forward of the seat back 14. One end of the webbing portion 30 is secured at 31 to the seat 12. The webbing portion 30 extends through a tongue assembly 32 which is engageable with the buckle assembly 26. The webbing portion 30 extends rearward, in a direction as indicated by the arrow 34, through an opening 36 in the seat back 14. A portion 38 of the shoulder belt webbing 28 is disposed behind the seat back 14 and is connected with a bar 40 to which the other shoulder belt webbing (not shown) is also connected.

A portion 42 of an adjust belt 44 is connected with the bar 40. The adjust belt portion 42 extends under the seat bottom cushion 16 into a webbing adjuster 50. The webbing adjuster 50 is disposed in a pocket 52 in the seat bottom cushion 16, near the front of the seat bottom cushion.

Figure 2:
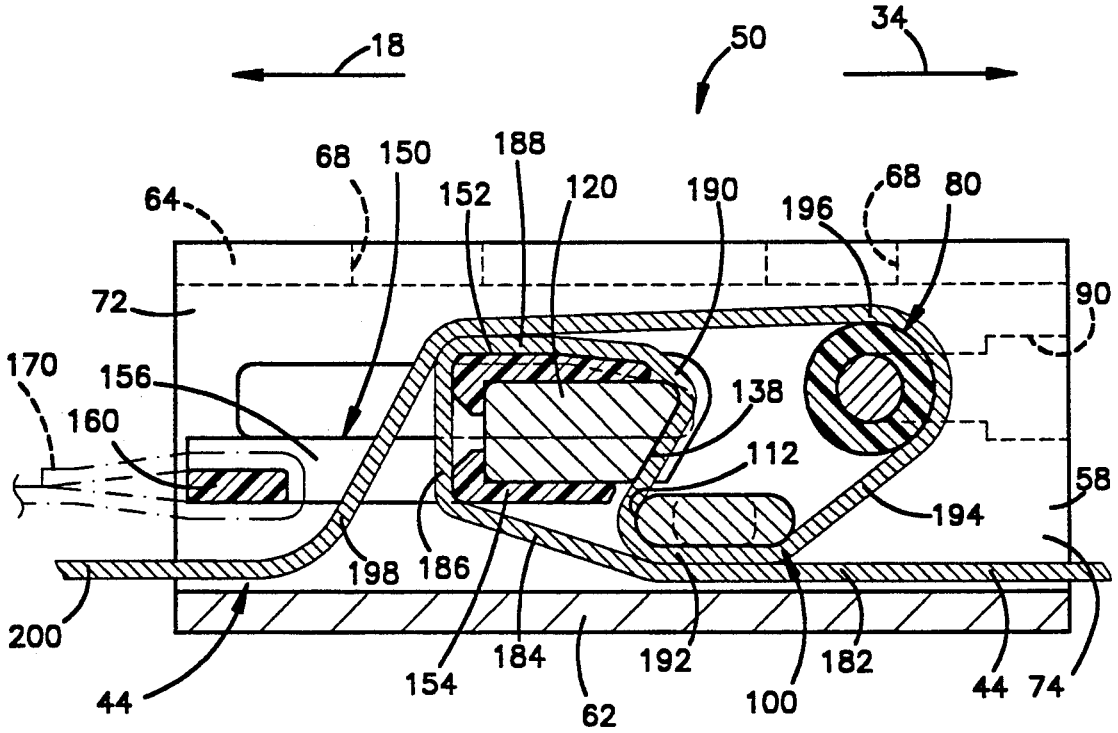
FIG. 2 is a longitudinal sectional view of the webbing adjuster of FIG. 1, shown in a locked condition blocking adjustment of the shoulder belt webbing.
Figure 4:
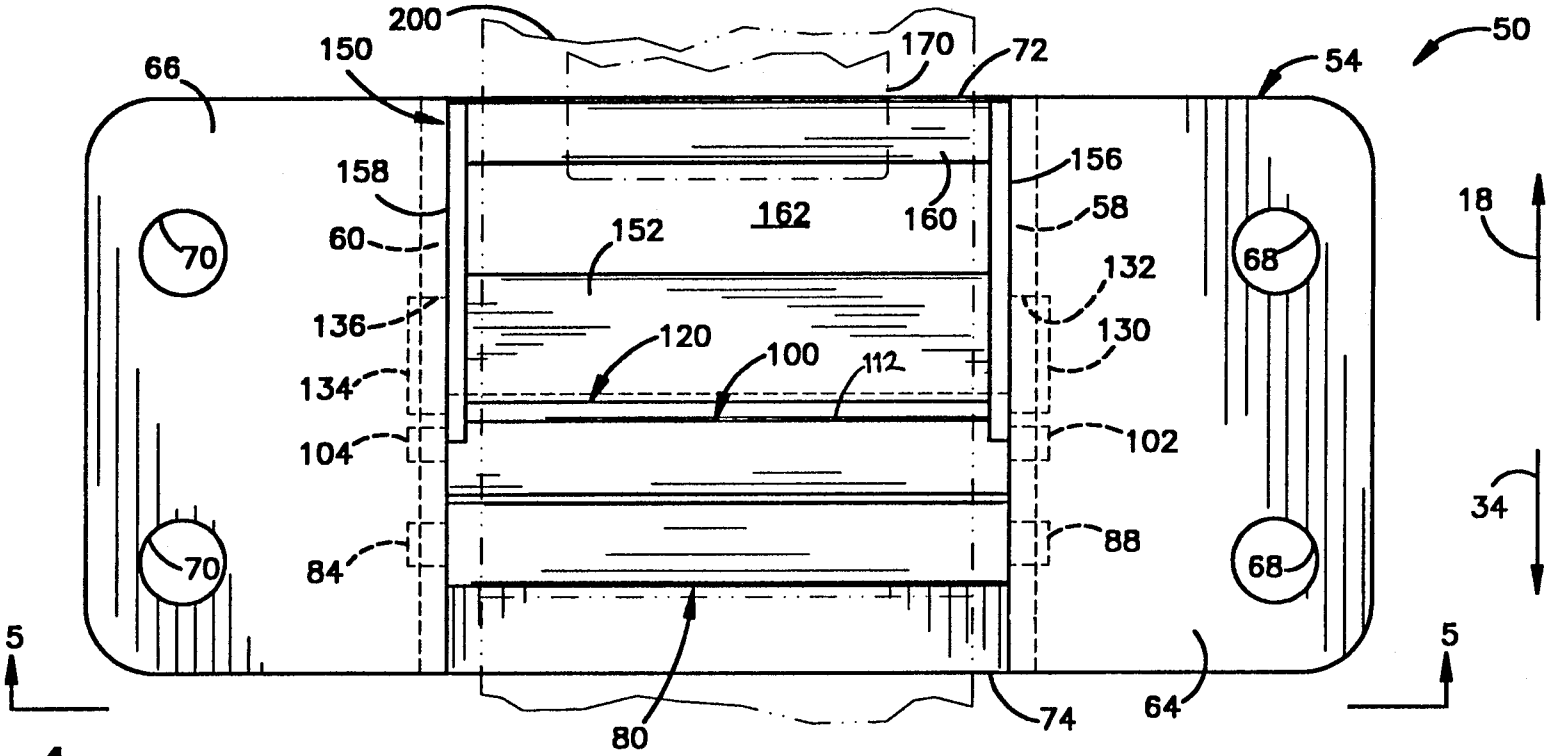
FIG. 4 is a top plan view of the adjuster of FIGS. 2 and 3.
Figure 5:
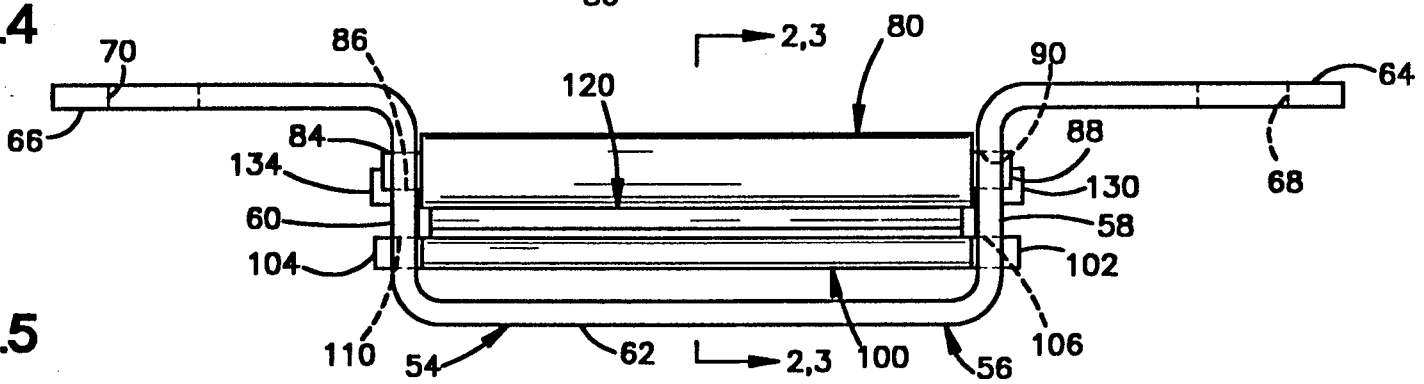
FIG. 5 is a rear elevational view of the adjuster of FIGS. 2–4.

The adjuster 50 includes a metal base 54 (FIGS. 4 and 5). The base 54 has a U-shaped center portion 56 (FIG. 5) which includes two side portions 58 and 60 and a bottom portion 62 extending between and interconnecting the side portions. The bottom portion 62 and the side portions 58 and 60 partially define between them, at the front of the adjuster 50, an adjust belt entrance opening 72 (FIG. 2) in the adjuster through which belt webbing is extensible. The bottom portion 62 and the side portions 58 and 60 partially define between them, at the rear of the adjuster 50, an adjust belt exit opening 74 in the adjuster through which belt webbing is extensible.

A flange portion 64 of the base 54 extends outward from the base side portion 58. A similar flange portion 66 of the base 54 extends outward from the side portion 60. Two fastener openings 68 in the flange portion 64 and two fastener openings 70 in the flange portion 66 receive fasteners (not shown) for securing the adjuster 50 in the pocket 52 in the seat bottom cushion 16.

The adjuster 50 includes a guide roller 80 rotatably mounted in the center portion 56 of the base 54, near the adjust belt exit opening 74. The guide roller 80 has one end portion 84 received in a slot 86 in the base side portion 60. The other end portion 88 of the guide roller 80 is received in a slot 90 in the other base side portion 58.

Figure 3:
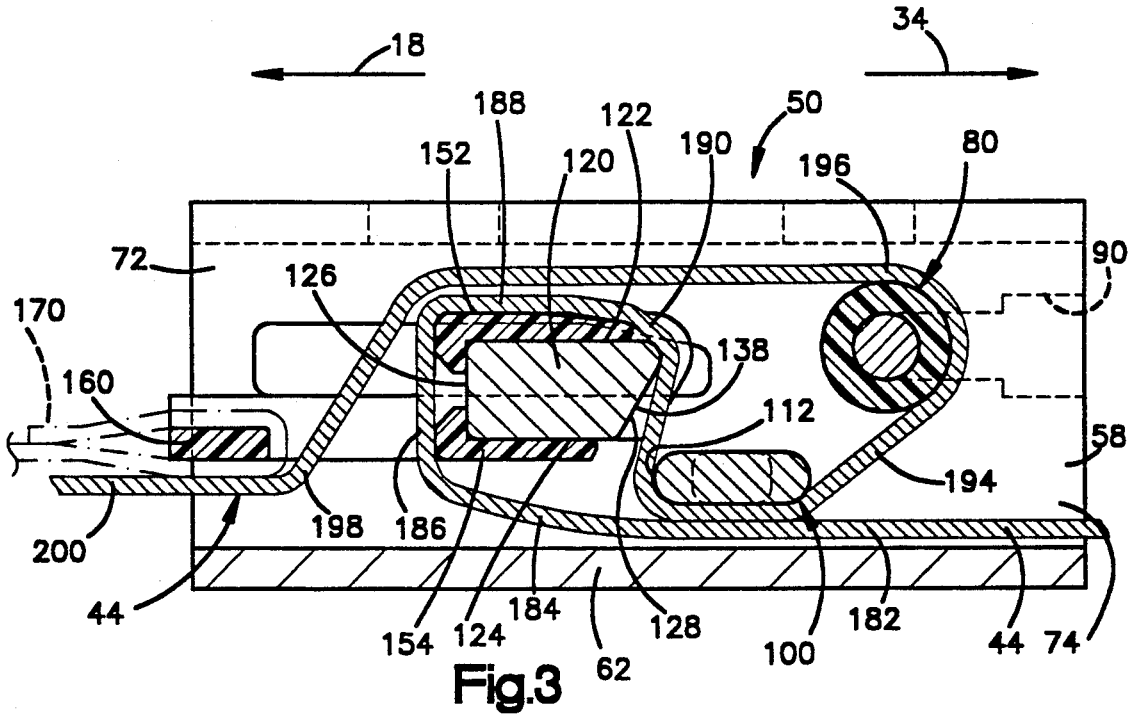
FIG. 3 is a sectional view similar to FIG. 2 showing the adjuster in a release position enabling adjustment of the shoulder belt webbing.

The adjuster 50 also includes a metal lock bar 100 fixed in the center portion 56 of the base 54, forward of the guide roller 80. The lock bar 100 has opposite end portions 102 and 104. The lock bar end portion 102 is received in an opening 106 in the base side portion 58. The lock bar end portion 104 is received in an opening 110 in the other base side portion 60. The lock bar 100 has a first clamping surface 112 (FIGS. 2 and 3) facing generally away from the guide roller 80.

Although the lock bar 100 is shown as a separate member fixed to the base 54, it should be understood that the lock bar 100 could be formed as a part of the base 54. For example, the base 54 could include a lock bar portion formed in one piece with and extending between the base side portions 58 and 60 and spaced from the base bottom portion 62. Such a lock bar portion would include the first clamping surface 112, and would perform the same clamping function as is performed by the lock bar 100.

The adjuster 50 also includes a metal slide bar 120 slidable on the center portion 56 of the base 54. The slide bar 120 is a generally rectangular metal bar having upper and lower major side surfaces 122 and 124, respectively. A front side surface 126 extends vertically between the upper and lower major side surfaces 122 and 124. A rear side surface 128 of the slide bar 120 extends at an angle downward and forward from the rear edge of the upper major side surface 122 and interconnects the upper major side surface with the lower major side surface 124.

One end portion 130 of the slide bar 120 is received in a slot 132 in the base side portion 58. The other end portion 134 of the slide bar 120 is received in a slot 136 in the other base side portion 60. The slide bar end portions 130 and 134 support the slide bar 120 for sliding movement on the base 54, forward in a direction as indicated by the arrow 18 and rearward in a direction as indicated by the arrow 34.

Formed on the slide bar 120 is a second clamping surface 138 at or about the intersection of the slide bar lower major side surface 124 and the rear side surface 128. The second clamping surface 138 is disposed adjacent to and facing generally toward the first clamping surface 112 of the lock bar 100. A biasing spring (not shown) may be provided to bias the slide bar 120 rearward into the locking position shown in FIG. 2.

The adjuster 50 includes a plastic release handle 150 (FIG. 2) connected for movement with the slide bar 120. The release handle 150 has an upper portion 152 which extends along the upper major side surface 122 of the slide bar 120 and along a portion of the front side surface 126 of the slide bar. The release handle 150 has a lower portion 154 which extends along the lower major side surface 124 of the slide bar 120 and along a portion of the front side surface 126 of the slide bar 120. Parallel side connector portions 156 and 158 of the release handle 150 interconnect the upper and lower portions 152 and 154 of the release handle. The side connector portions 156 and 158 extend rearward of the release handle upper and lower portions 152 and 154 and grip around the rear side surface 128 of the slide bar 120. The side connector portions 156 and 158 extend forward of the upper and lower portions 152 and 154, to the adjust belt entrance opening 72 of the adjuster 50.

A pull tab portion 160 of the release handle 150 is disposed in the adjust belt entrance opening 72 of the adjuster 50. The pull tab 160 extends between and interconnects the side connector portions 156 and 158 of the release handle 150. The pull tab 160, the release handle connector side portions 156 and 158, and the upper and lower portions 152 and 154 of the release handle, together define between them a webbing opening 162 (FIG. 4) in the release handle 150.

The adjuster 50 may optionally include a pull tab webbing 170 (FIGS. 1–4). The pull tab webbing 170 is preferably a relatively short length of belt webbing about one inch wide. The pull tab webbing 170 extends around the pull tab 160 and through the webbing opening 162. The pull tab webbing extends forward from the pull tab 160, through the adjust belt entrance opening 72, to a location forward of and outside of the base 54.

The adjust belt 44 (FIGS. 1–3) extends through the adjuster 50 between the adjust belt entrance opening 72 and the adjust belt exit opening 74. The adjust belt 44 includes a first portion 182 extending horizontally and forward from the adjust belt exit opening 74 and underneath the lock bar 100. A second portion 184 of the adjust belt 44 extends at an angle upward and forward from the first portion 182 to the webbing opening 162 in the release handle 150. The adjust belt second portion 184 extends forward under the slide bar 120.

A third portion 186 of the adjust belt 44 extends upward through the webbing opening 162 in the release handle 150. A fourth portion 188 of the adjust belt 44 extends rearward from the third portion 186 across the upper portion 152 of the release handle 150. The adjust belt fourth portion 188 extends rearward over the slide bar 120.

A fifth portion 190 of the adjust belt 44 extends at an angle downward and forward from the top of the slide bar 120 to the forward edge of the lock bar 100. The adjust belt fifth portion 190 thus extends between the first clamping surface 112 on the lock bar 100 and the second clamping surface 138 on the slide bar 120. A sixth portion 192 of the adjust belt 44 extends rearward from the fifth portion 190, underneath the lock bar 100.

A seventh portion 194 of the adjust belt 44 extends at an angle upward and rearward from the lock bar 100 to the guide roller 80. An eighth portion 196 of the adjust belt 44 extends from the seventh portion 194, wraps around the guide roller 80, and extends forward from the guide roller over the slide bar 120.

A ninth portion 198 of the adjust belt 44 extends at an angle forward and downward from the eighth portion 196, through the webbing opening 162 in the release handle 150, to a location underneath the pull tab 160. A tenth and terminal portion 200 of the adjust belt 44 extends forward from underneath the pull tab 160, through the adjust belt entrance opening 72 of the adjuster 50, to a location forward of and outside of the base 54.

In operation of the seat belt system 10, the tongue assembly 32 is engaged with the buckle assembly 26 after the child is seated in the seat 12. If the shoulder belt webbing 28 is too loose, the shoulder belt webbing is adjusted by manually gripping and pulling forward on the adjust belt end portion 200. This pulling action draws the adjust belt 44 through the adjuster 50 in a forward direction as indicated by the arrow 18. Because the adjust belt 44 is connected with the shoulder belt webbing 28, as the adjust belt is pulled through the adjuster 50, the shoulder belt webbing 28 moves rearward through the seat back opening 36. The shoulder belt webbing 28 is thereby tightened as desired.

Once the shoulder belt webbing 28 is properly adjusted, forward movement of the child's torso relative to the seat back 14, such as occurs in sudden vehicle deceleration, tensions the shoulder belt webbing 28. The tensile forces on the shoulder belt webbing 28 are transmitted into the adjust belt 44 and move the slide bar 120 rearward relative to the base 54. The fifth portion 190 of the adjust belt 44 is clamped between the first clamping surface 112 on the lock bar 100 and the second clamping surface 138 on the slide bar 120. This clamping action blocks further movement of the adjust belt 44 through the adjuster 50, thus maintaining the shoulder belt webbing 28 tight and restraining forward movement of the child in the seat 12.

When securing a child in the seat 12, it may instead be necessary to loosen the shoulder belt webbing 28 in order to fit the shoulder belt webbing properly across the shoulders of the child. To do this, the pull tab 160, or the pull tab webbing 170, is manually gripped and pulled forward in the direction indicated by the arrow 18. The forward movement of the pull tab 160 is transmitted through the other portions of the release handle 150 to the slide bar 120. The slide bar 120 moves forward, from the locking position illustrated in FIG. 2 to the release position illustrated in FIG. 3.

When the slide bar 120 is in the release position, the second clamping surface 138 on the slide bar is moved away from the first clamping surface 112 on the lock bar 100. The adjust belt 44 can move through the adjuster 50 between the clamping surfaces 112 and 138. The shoulder belt webbing 28 is manually pulled through the opening 36 in the vehicle seat back in a forward direction as indicated by the arrow 18, to loosen the shoulder belt webbing 28. This pulling action draws the adjust belt 44 rearward through the adjuster 50. Adjust belt webbing enters the adjuster 50 through the adjust belt entrance opening 72 and exits the adjuster 50 through the adjust belt exit opening 74. Once the shoulder belt webbing 28 has been loosened sufficiently, the tongue assembly 32 is engaged with the buckle assembly 26 to secure the child in the seat 12. The system 10 may then be tightened, if necessary, by pulling forward on the adjust belt end portion 200 to draw belt webbing forward through the adjuster 50 to snug up the shoulder belt webbing 28.

As can be seen in FIG. 1, the pull tab 160, the pull tab webbing 170, and the adjust belt end portion 200 are exposed at the forward end of the adjuster 50. This facilitates adjustment of the seat belt system 10 by an adult or other person securing the child in the seat 12. However, the pull tab 160, the pull tab webbing 170, and the adjust belt end portion 200, are inaccessible to a child seated in the seat 12. Thus, a child cannot accidentally or intentionally loosen the system 10 to place the system in an unsafe condition. This safety feature is also aided by the placement of the adjuster 50 at a forward location underneath the seat bottom cushion 16.

The operation of the seat belt system 10 is also aided by the provision of the guide roller 80 in the adjuster 50. The guide roller 80 changes the direction of the path of movement of the adjust belt 44 in the adjuster 50. Thus, the adjust belt portion 44 extends rearward from the lock bar 100, then wraps around the guide roller 80 so that the adjust belt end portion 200 extends from the front of the adjuster 50. The adjust belt end portion 200 is thus easily grasped to tighten the shoulder belt webbing 28.

The present invention is illustrated in conjunction with an integrated child seat having an adjuster 50 disposed within a pocket 52 on the underside of a seat bottom cushion 16. Other uses of the invention are contemplated. Specifically, the adjuster 50 could be secured to the bottom of a child seat bottom cushion, rather than in a pocket within the seat bottom cushion. The adjuster 50 could also be used in conjunction with a portable child seat rather than with an integrated child seat. Further, a restraint system including belt webbing and an adjuster 50 could be used to restrain forward movement of a vehicle occupant other than a child, seated in other than a child seat.

From the above description of the invention, those skilled in the art will perceive improvements, changes and modifications in the invention. Such improvements, changes and modifications within the skill of the art are intended to be covered by the appended claims.

I claim:

1. A seat belt retraining apparatus for restraining movement of a child in a child seat, said apparatus comprising:

a shoulder belt webbing extensible across a shoulder of a child seated in the child seat to restrain movement of the child relative to the child seat;

an adjust belt connected with said shoulder belt webbing and being movable to adjust said shoulder belt webbing; and means for blocking movement of said adjust belt to block adjustment of said shoulder belt webbing and for enabling movement of said adjust belt to enable adjustment of said shoulder belt webbing, said means for blocking and for enabling comprising an adjuster associated with said adjust belt, said adjuster having a locked condition blocking movement of said adjust belt to block adjustment of said shoulder belt webbing and a release condition enabling movement of said adjust belt to enable adjustment of said shoulder belt webbing, said adjuster comprising:

a base for connection with the child seat;

clamping means for clamping said adjust belt to block movement of said adjust belt, said clamping means comprising a slide bar around which said adjust belt extends and which is slidable on said base between a clamping position blocking movement of said adjust belt and a release position enabling movement of said adjust belt; and a pull tab connected with said slide bar for movement with said slide bar, said pull tab being manually movable to move said slide bar from the clamping position to the release position to enable movement of said adjust belt.

2. An apparatus as set forth in claim 1 wherein said pull tab is spaced from said slide bar and is disposed adjacent an entrance opening of said adjuster, said adjuster including a handle member having said pull tab, said handle member having a first portion gripping said slide bar and a connector portion extending between said first portion and said pull tab and interconnecting said first portion for movement with said pull tab.

3. An apparatus as set forth in claim 2 wherein said pull tab, said first portion of said handle member, and said connector portion of said handle member define between them a webbing opening through which said adjust belt extends between a location above said pull tab and a location below said pull tab.

4. An apparatus as set forth in claim 1 wherein said adjuster has portions defining a rear webbing opening through which said adjust belt extends and portions defining a front webbing opening through which said adjust belt extends, said front and rear webbing openings being disposed at opposite ends of said adjuster, said pull tab being disposed adjacent said front webbing opening of said adjuster.

5. An apparatus as set forth in claim 4 wherein said adjuster includes a guide roller for guiding movement of said adjust belt in said adjuster, said guide roller being spaced from said slide bar, said adjust belt extending in said adjuster from said slide bar around said guide roller and thence forward to a location adjacent to said pull tab at which said adjust belt can be manually gripped to move said adjust belt.

6. An apparatus as set forth in claim 1 wherein said base has a first clamping surface, said first clamping surface being fixed relative to the child seat when said base is connected with the child seat, said slide bar having a second clamping surface movable with said slide bar relative to said first clamping surface, said adjust belt extending between said first and second clamping surfaces, said slide bar when in the clamping position clamping said adjust belt between said first and second clamping surfaces, said slide bar when moved to the release position moving said second clamping surface away from said first clamping surface to allow movement of said adjust belt between said first and second clamping surfaces.

7. An apparatus as set forth in claim 1 wherein said adjuster base includes a lock bar portion having a first clamping surface, said slide bar having a second clamping surface adjacent said first clamping surface, said adjust belt being extensible between said first and second clamping surfaces, said slide bar being movable with said pull tab upon the manual application of force to said pull tab to move said second clamping surface away from said first clamping surface to enable adjustment of said shoulder belt webbing.

8. An apparatus as set forth in claim 7 wherein said adjuster includes a guide roller rotatably mounted to said base for guiding movement of said adjust belt in said adjuster, said guide roller being spaced from said slide bar and from said lock bar portion of said base, said adjust belt extending rearward in said adjuster from said slide bar around said guide roller and thence forward to a location adjacent to said pull tab at which said adjust belt can be manually gripped to move said adjust belt.

9. An apparatus as set forth in claim 1 wherein said adjuster includes a pull tab webbing extending from said pull tab and manually engageable to move said pull tab and said slide bar to enable movement of said adjust belt in said adjuster.

10. A seat belt restraining apparatus for restraining movement of a child in a child seat having a seat back and a seat bottom cushion which extends forward of the seat back, said apparatus comprising:

a shoulder belt webbing extensible across a shoulder of the child to restrain movement of the child relative to the child seat;

an adjust belt connected with said shoulder belt webbing and being movable to adjust said shoulder belt webbing; and means for blocking movement of said adjust belt to block adjustment of said shoulder belt webbing and for enabling movement of said adjust belt to enable adjustment of said shoulder belt webbing, said means for blocking and for enabling comprising an adjuster associated with said adjust belt, said adjuster having a locked condition blocking movement of said adjust belt to block adjustment of said shoulder belt webbing and a release condition enabling movement of said adjust belt to enable adjustment of said shoulder belt webbing, said adjuster comprising:

a base for connection with the child seat;

clamping means for clamping said adjust belt to block movement of said adjust belt, said clamping means comprising a slide bar around which said adjust belt extends and which is slidable on said base between a clamping position blocking movement of said adjust belt and a release position enabling movement of said adjust belt; and a guide roller around which said adjust belt extends and which is rotatably connected with said base;

said adjust belt extending in said adjuster forward under said slide bar and rearward over said slide bar and thence around said guide roller and forward to a location at which said adjust belt can be manually gripped to move said adjust belt.

11. An apparatus as set forth in claim 10 wherein said guide roller is rotatably mounted on said base at a location adjacent a rear webbing opening of said adjuster.

12. An apparatus as set forth in claim 10 wherein said adjuster base includes a lock bar portion having a first clamping surface, said slide bar having a second clamping surface adjacent said first clamping surface, said adjust belt being extensible between said first and second clamping surfaces, said guide roller being spaced from said slide bar and from said lock bar portion of said base, said adjust belt extending rearward in said adjuster from said slide bar around said guide roller and thence forward to a location adjacent to said pull tab at which said adjust belt can be manually gripped to move said adjust belt.

13. An apparatus as set forth in claim 10 wherein said adjuster includes a pull tab connected with said slide bar for movement with said slide bar, said pull tab being manually movable to move said slide bar from the clamping position to the release position to enable movement of said adjust belt.

14. A seat belt restraining apparatus for restraining movement of a vehicle occupant in a vehicle seat, said apparatus comprising:

a belt webbing extensible around the vehicle occupant to restrain movement of the vehicle occupant relative to the vehicle seat;

an adjust belt connected with said belt webbing and being movable to adjust said belt webbing; and means for blocking movement of said adjust belt to block adjustment of said shoulder belt webbing and for enabling movement of said adjust belt to enable adjustment of said shoulder belt webbing, said means for blocking and for enabling comprising an adjuster associated with said adjust belt and having a locked condition blocking movement of said adjust belt to block adjustment of said belt webbing and a release condition enabling movement of said adjust belt to enable adjustment of said belt webbing, said adjuster comprising:

a base for connection with the vehicle seat;

clamping means for clamping said adjust belt to block movement of said adjust belt, said clamping means comprising a slide bar around which said adjust belt extends and which is slidable on said base between a clamping position blocking movement of said adjust belt and a release position enabling movement of said adjust belt;

a guide roller around which said adjust belt extends and which is rotatably connected with said base;

said adjust belt extending in said adjuster in a first direction under said slide bar and in a second direction opposite to said first direction over said slide bar and thence around said guide roller and thence in said first direction to a location outside of said adjuster at which said adjust belt can be manually gripped.

* * * * *